US007221085B2

(12) United States Patent
Murata et al.

(10) Patent No.: US 7,221,085 B2
(45) Date of Patent: May 22, 2007

(54) IMAGE DISPLAY DEVICE THAT INCLUDES A METAL BACK LAYER WITH GAPS

(75) Inventors: Hirotaka Murata, Fukaya (JP); Hiroaki Ibuki, Ageo (JP); Takashi Nishimura, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/403,863

(22) Filed: Apr. 14, 2006

(65) Prior Publication Data

US 2006/0181194 A1 Aug. 17, 2006

Related U.S. Application Data

(63) Continuation of application No. PCT/JP2004/015117, filed on Oct. 14, 2004.

(30) Foreign Application Priority Data

Oct. 17, 2003 (JP) ..... 2003-357823

(51) Int. Cl.
*H01J 1/62* (2006.01)
*H01J 1/304* (2006.01)

(52) U.S. Cl. ..... 313/496; 313/495; 313/309; 313/310; 315/169.1; 315/169.3

(58) Field of Classification Search ..... 313/495–497, 313/309–310; 315/169.1, 169.3
See application file for complete search history.

(56) References Cited

U.S. PATENT DOCUMENTS 6,677,706 B1 1/2004 Hara et al.
6,771,236 B1 8/2004 Konishi et al.
7,071,610 B2 * 7/2006 Takenaka et al. ..... 313/496
2004/0195958 A1 10/2004 Ito et al.
2006/0103294 A1 * 5/2006 Suzuki et al. ..... 313/496

FOREIGN PATENT DOCUMENTS

| | | | |
|---|---|---|---|
| CN | 1289044 | A | 3/2001 |
| EP | 0 866 491 | A2 | 9/1998 |
| EP | 1 432 004 | A1 | 6/2004 |
| JP | 10-214581 | | 8/1998 |
| JP | 10-326583 | | 12/1998 |
| JP | 11-185673 | | 7/1999 |
| JP | 2000-251797 | | 9/2000 |
| JP | 2000-311642 | | 11/2000 |
| JP | 2001-243893 | | 9/2001 |
| JP | 2001-325904 | | 11/2001 |
| JP | 2003-68237 | | 3/2003 |
| JP | 2003-217451 | | 7/2003 |
| JP | 2003-242911 | | 8/2003 |
| KR | 10-0340890 | | 6/2002 |
| WO | WO 03/019608 | A1 | 3/2003 |

* cited by examiner

*Primary Examiner*—Karabi Guharay
(74) *Attorney, Agent, or Firm*—Oblon, Spivak, McClelland, Maier & Neustadt, P.C.

(57) ABSTRACT

A front substrate of an image display device has a phosphor screen and a metal back layer superposed on the phosphor screen. A plurality of electron emitting elements which emit electrons toward the phosphor screen are located on a rear substrate opposed to the front substrate. The metal back layer has a region which corresponds to the phosphor screen and is divided by gaps g1 in a first direction and gaps g2 in a second direction perpendicular to the first direction such that there are relations g1<g2, and ρg1<ρg2, where ρg1 and ρg2 are sheet resistances at the gaps g1 and g2, respectively.

4 Claims, 4 Drawing Sheets

IMAGE DISPLAY DEVICE THAT INCLUDES A METAL BACK LAYER WITH GAPS

CROSS-REFERENCE TO RELATED APPLICATIONS

This is a Continuation Application of PCT Application No. PCT/JP2004/015117, filed Oct. 14, 2004, which was published under PCT Article 21(2) in Japanese.

This application is based upon and claims the benefit of priority from prior Japanese Patent Application No. 2003-357823, filed Oct. 17, 2003, the entire contents of which are incorporated herein by reference.

BACKGROUND OF THE INVENTION

1. Field of the Invention

This invention relates to a flat image display device provided with a pair of substrates opposed to each other.

2. Description of the Related Art

Various flat image display devices have been developed as a next generation of image display devices in which a large number of electron emitting elements are arranged side by side and opposed to a phosphor screen. While there are various types of electron emitting elements for use as electron emission sources, all of them basically utilize field emission. Display devices that use these electron emitting elements are generally called field emission displays (hereinafter, referred to as FED's). Among the FED's, a display device that uses surface-conduction electron emitting elements is also called a surface-conduction electron emission display (hereinafter, referred to as an SED). In this specification, however, the term "FED" is used as a generic name for devices including the SED.

In general, an FED comprises a front substrate and a rear substrate that are opposed to each other with a given gap between them. These substrates have their respective peripheral portions joined together by a sidewall in the shape of a rectangular frame, thereby constituting a vacuum envelope. The interior of the vacuum envelope is kept at a high vacuum such that the degree of vacuum is about $10^{-4}$ Pa or below. In order to support an atmospheric load that acts on the front substrate and the rear substrate, a plurality of support members are located between these substrates.

A phosphor screen that includes red, blue, and green phosphor layers is formed on the inner surface of the front substrate, and a number of electron emitting elements that emit electrons for exciting the phosphor to luminescence are provided on the inner surface of the rear substrate. Further, a number of scan lines and signal lines are formed in a matrix and connected to the electron emitting elements. An anode voltage is applied to the phosphor screen, and electron beams emitted from the electron emitting elements are accelerated by the anode voltage and collide with the phosphor screen, whereupon the phosphor glows and displays an image.

In the FED of this type, the gap between the front and rear substrates can be set to several millimeters or less. When compared with a cathode-ray tube (CRT) that is used as a display of an existing TV or computer, therefore, the FED can achieve lighter weight and smaller thickness.

In order to obtain practical display characteristics for the FED constructed in this manner, it is necessary to use a phosphor that resembles that of a conventional cathode-ray tube and to use a phosphor screen that is obtained by forming a thin aluminum film called a metal back on the phosphor. In this case, the anode voltage to be applied to the phosphor screen is set to at least several kV, and preferably, to 10 kV or more.

In view of the resolution, the properties of the support members, etc., the gap between the front substrate and the rear substrate cannot be made very wide and is set to about 1 to 2 mm. In the FED, therefore, a strong electric field is inevitably formed in the narrow gap between the front substrate and the rear substrate, so that electric discharge between the substrates raises a problem.

If no countermeasures are taken to restrain electric discharge damage, electric discharge inevitably causes breakage or degradation of the electron emitting elements and their connected thin-film electrodes, phosphor screen, driver IC, and drive circuit. These phenomena will be referred to collectively as electric discharge damage. In a situation that involves such damage, electric discharge must be absolutely prevented from being generated for a long period of time in order to put the FED into practical use. However, it is very difficult to realize this.

Accordingly, it is essential to take a countermeasure to reduce the discharge current so that electric discharge, if any, can be restricted to a level such that no or negligible electric discharge damage occurs. A technique to attain this is described in Jpn. Pat. Appln. KOKAI Publication No. 2000-311642. According to this technique, a metal back on a phosphor screen is notched to form a zigzag or other pattern, whereby the effective impedance of the phosphor screen is enhanced. Described in Jpn. Pat. Appln. KOKAI Publication No. 10-326583, moreover, is a technique in which a metal back is divided and connected to a common electrode through a resistance member so that high voltage can be applied. Described in Jpn. Pat. Appln. KOKAI Publication No. 2000-251797, furthermore, is a technique in which divided parts of a metal back are coated with an electrically conductive material to restrain discharge at the divided parts. Described in Jpn. Pat. Appln. KOKAI Publication No. 2003-242911 is a technique in which a metal back is divided or patterned, and moreover, a resistive material is used for the metal back.

However, a continued examination has revealed that the discharge current can be reduced only to about 3 A by such technique, among other prior art techniques, in which the metal back is divided in the longitudinal direction with a high discharge current limiting effect.

Thus, breakage of the phosphor screen and the driver IC can be prevented. Electron sources can be prevented substantially securely from being damaged. If any electric discharge that involves the electron emitting elements takes place, though rarely, however, point defects may occur in some cases. Further, a countermeasure to restrain disconnection of the thin-film electrodes that are connected to the electron emitting elements causes an increase of processes in number and cost increase. On the other hand, the driver IC must be specially designed to cope with a current of about 3 A, so that cost increase is caused. Accordingly, there has been an increasing demand for a technique capable of reducing the discharge current.

BRIEF SUMMARY OF THE INVENTION

The present invention has been made to solve these problems, and its object is to provide an image display device in which discharge current of electric discharge generated between a front substrate and a rear substrate can be considerably reduced compared with the prior art techniques.

In order to achieve the object, an image display device according to an aspect of the invention comprises: a front substrate having a phosphor screen, which includes phosphor layers and a light shielding layer, and a metal back layer superposed on the phosphor screen; and a rear substrate opposed to the front substrate and having thereon a plurality of electron emitting elements which emit electrons toward the phosphor screen, the metal back layer having a region which corresponds to the phosphor screen and is divided by gaps g1 in a first direction and gaps g2 in a second direction perpendicular to the first direction such that there are relations:

$$g1<g2, \text{ and } \rho g1<\rho g2,$$

where ρg1 and ρg2 are sheet resistances at the gaps g1 and g2, respectively.

There are relations:

$$0.5 \leqq (Rg1/Rg2)^{1/2}/(g1/g2) \leqq 2.$$

where Rg1 and Rg2 are resistances at the gaps g1 and g2, respectively.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of an SED to which this invention is applied will now be described in detail with reference to the drawings.

Figure 1:
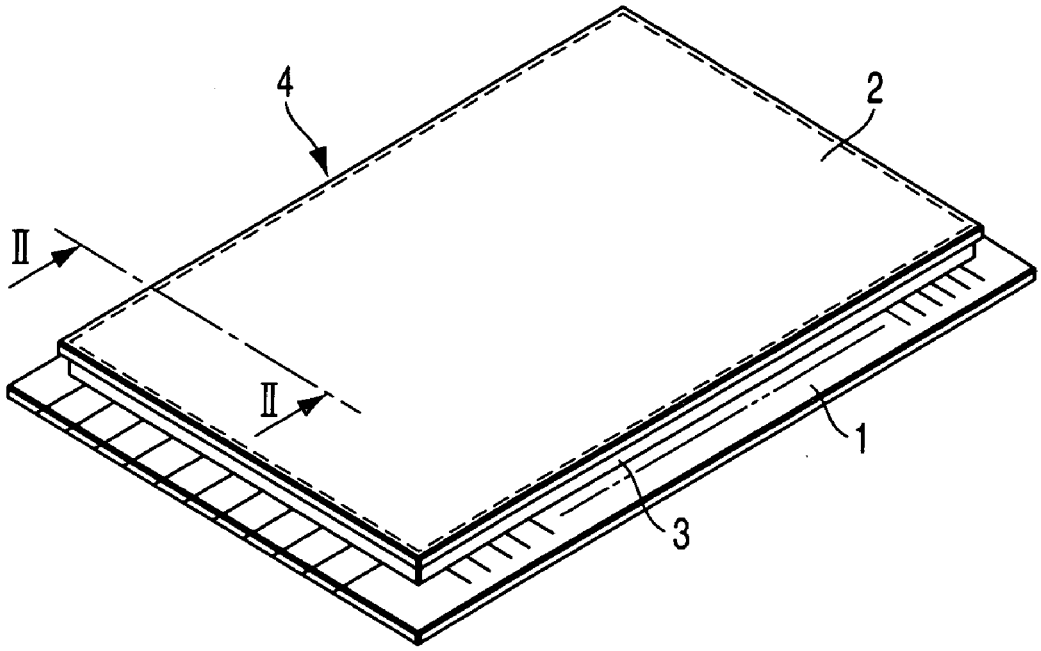
FIG. 1 is a perspective view showing an SED according to a first embodiment of this invention.
Figure 2:
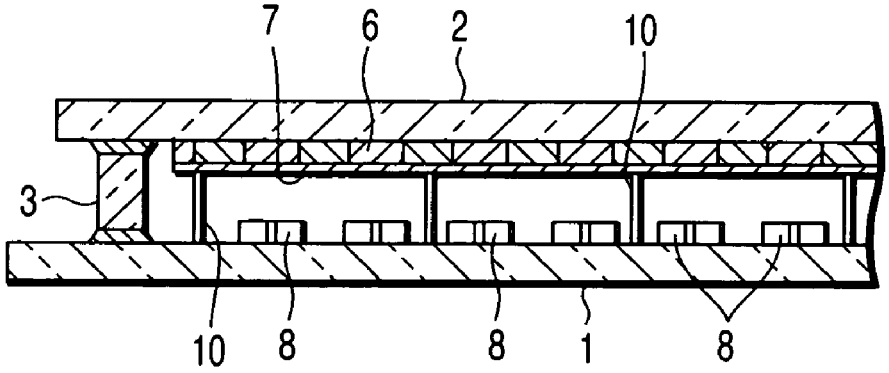
FIG. 2 is a sectional view of the SED taken along line II—II of FIG. 1.

FIGS. 1 and 2 show a structure of an SED common to the embodiments of this invention. The SED comprises a front substrate 2 and a rear substrate 1, which are formed of a rectangular glass plate each. These substrates are located opposite each other with a gap of about 1 to 2 mm between them. The front substrate 2 and the rear substrate 1 have their respective peripheral edge portions joined together by a sidewall 3 in the form of a rectangular frame, thereby forming a flat, rectangular vacuum envelope 4 of which the interior is kept at a high vacuum of about $10^{-4}$ Pa or less.

A phosphor screen 6 is formed on the inner surface of the front substrate 2. This phosphor screen 6 has phosphor layers, which glow red, green, and blue, individually, and a matrix-shaped light shielding layer. Formed on the phosphor screen 6 is a metal back layer 7 that functions as an anode. In display operation, a predetermined anode voltage is applied to the metal back layer 7. The construction of the phosphor screen 6 will be described in detail later.

Provided on the inner surface of the rear substrate 1 are a number of electron emitting elements 8, which individually emit electron beams for exciting the phosphor layers. These electron emitting elements 8 are arranged in a plurality of columns and a plurality of rows corresponding to individual pixels. The electron emitting elements 8 are driven by wiring (not shown) arranged in a matrix manner. A number of plate-shaped or columnar spacers 10 for supporting the atmospheric pressure that acts on the rear substrate 1 and the front substrate 2 are arranged between these substrates.

An anode voltage is applied to the phosphor screen 6 through the metal back layer 7, and electron beams emitted from the electron emitting elements 8 are accelerated by the anode voltage and collide with the phosphor screen 6. Thus, the corresponding phosphor layers glow and display an image.

Figure 3:
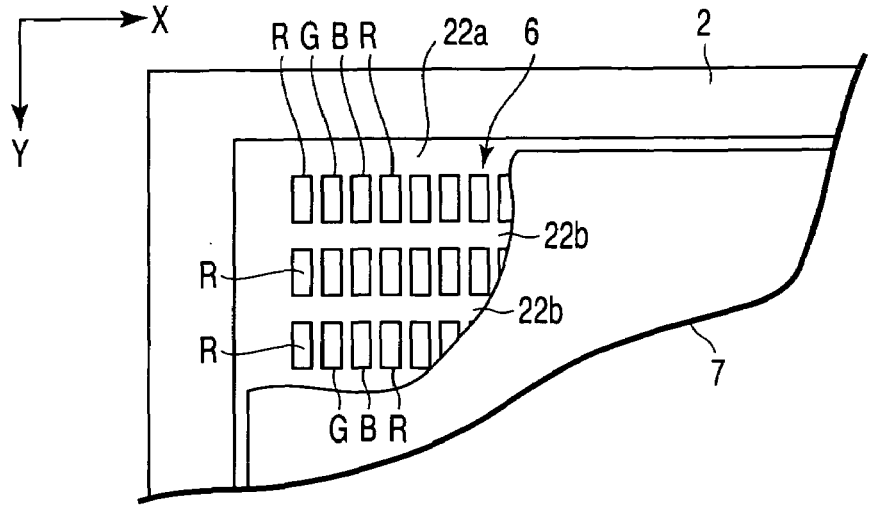
FIG. 3 is a plan view showing a phosphor screen and a metal back layer of a front substrate of the SED.

FIG. 3 shows a structure of the front substrate 2, especially the phosphor screen 6, common to the embodiments of this invention. The phosphor screen 6 has a number of rectangular phosphor layers R, G and B, which glow red, green, and blue, respectively. If the longitudinal direction of the front substrate 2 and the transverse direction perpendicular thereto are a first direction X and a second direction Y, respectively, the phosphor layers R, G and B are repeatedly arranged in the first direction X with given gaps between them, and the phosphor layers of the same colors are arranged in the second direction Y with given gaps between them. The gaps, although given, vary within a range of manufacturing errors or a range of fine adjustment in design, and do not always have fixed values. Further, the phosphor screen 6 has a light shielding layer 22. This light shielding layer 22 has a rectangular frame portion 22*a*, which extends along the peripheral edge portion of the front substrate 2, and a matrix portion 22*b*, which extends in a matrix between the phosphor layers R, G and B inside the rectangular frame portion.

Figure 4:
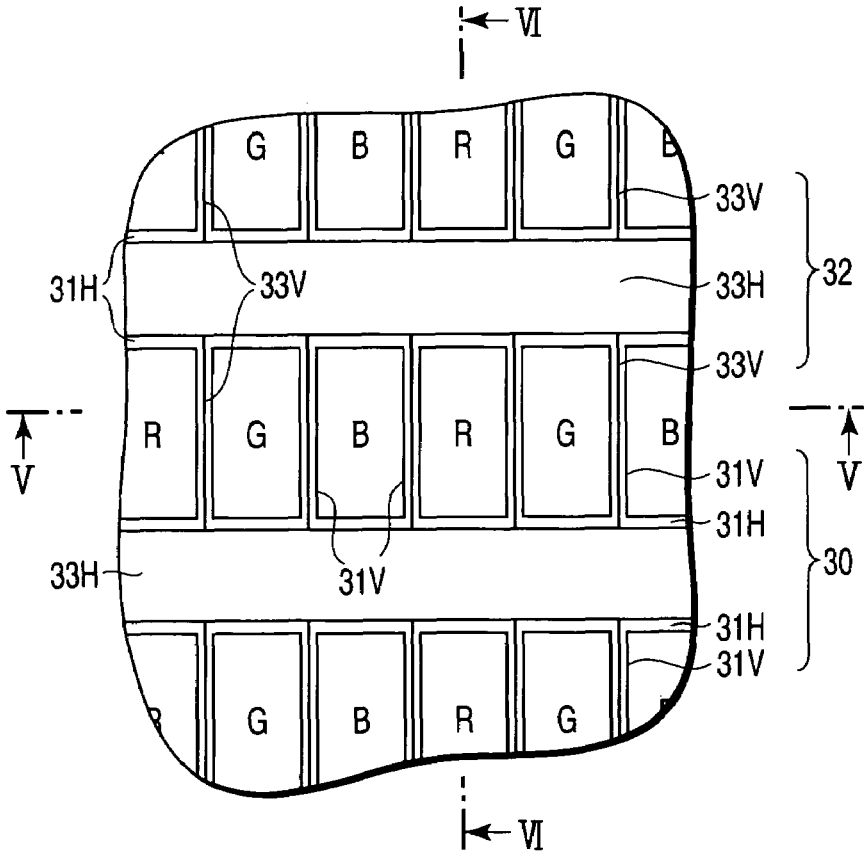
FIG. 4 is a plan view showing a phosphor screen portion of the SED.
Figure 5:
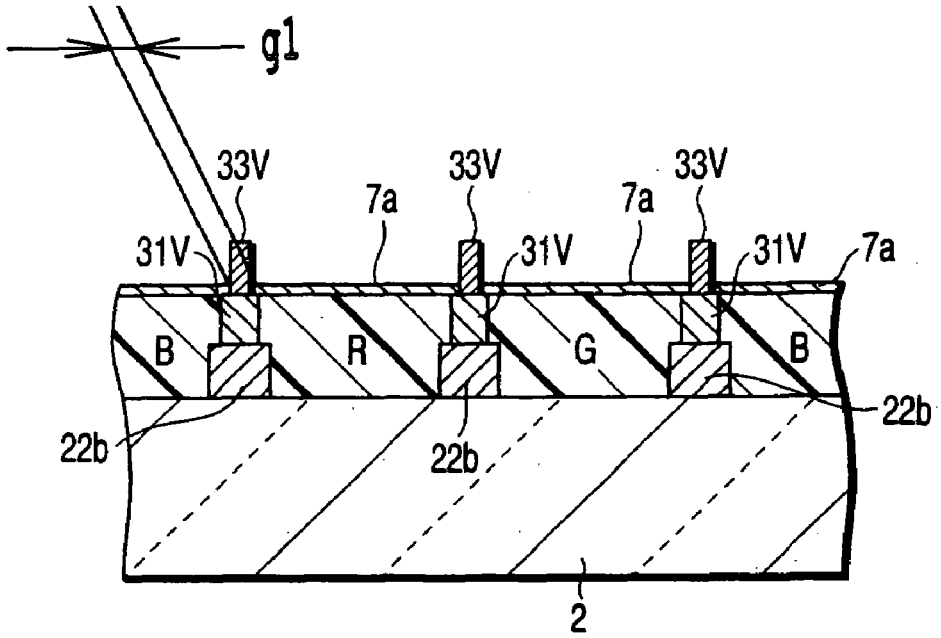
FIG. 5 is a sectional view of the phosphor screen and the like taken along line V—V of FIG. 4.
Figure 6:
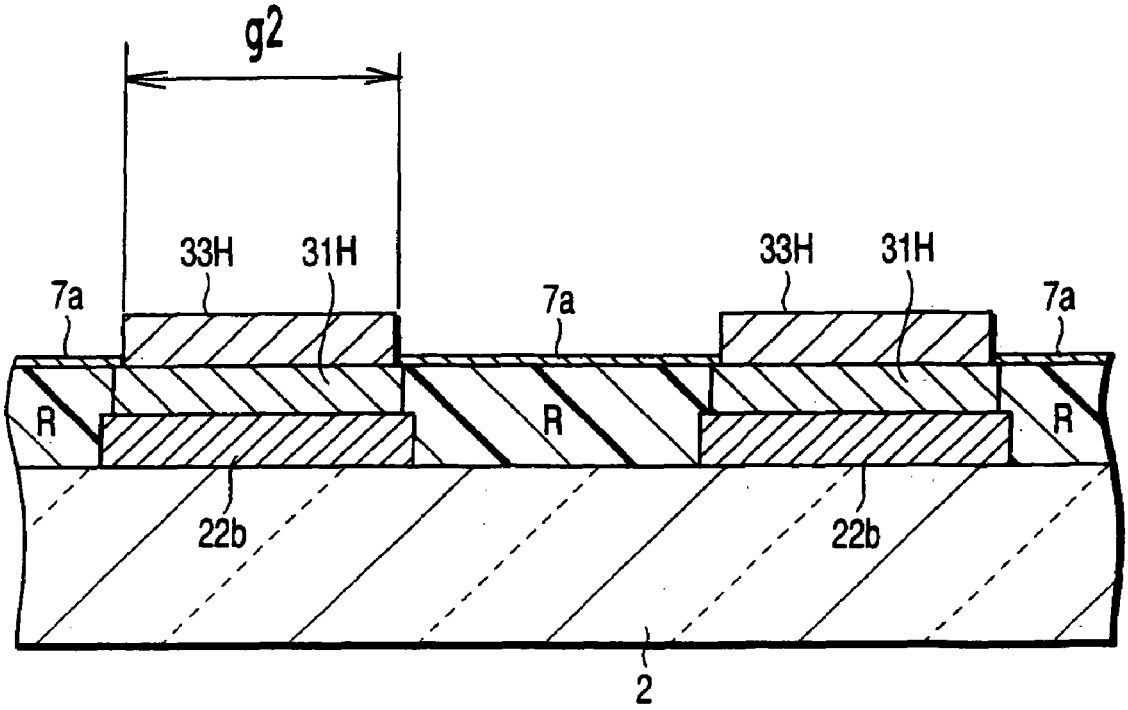
FIG. 6 is a sectional view of the phosphor screen and the like taken along line VI—VI of FIG. 4.

A first embodiment of the present invention will now be described in detail with reference to FIGS. 4 to 6. FIG. 4 is a plan view of the phosphor screen 6, and FIGS. 5 and 6 are sectional views in the X- and Y-directions, respectively, of the phosphor screen 6.

In the description to follow, suitable numerical values will be given as standards for dimensions for a case where pixels (assemblies of R, G and B) are square pixels that are arranged at pitches of 600 μm.

A resistance adjusting layer 30 is formed on the light shielding layer 22. In a region corresponding to the matrix portion 22*b*, the resistance adjusting layer 30 has a plurality of horizontal line portions 31H, which individually extend in the X-direction between the phosphor layers, and a plurality of vertical line portions 31V, which individually extend in the Y-direction between the phosphor layers. Since the phosphor layers R, G and B are arranged in the X-direction, the vertical line portions 31V are much narrower than the horizontal line portions 31H. For example, each vertical line portion 31V has a width of 40 μm, while each horizontal line portion 31H has a width of 300 μm.

A material used for the vertical line portions 31V has a resistance lower than that of a material for the horizontal line portions 31H. The values of these resistances will be mentioned later. The horizontal line portions 31H and the vertical line portions 31V are all formed using a material based on particulates of a resistive metal oxide by photolithography, a well-known technique. The phosphor layers R, G and B are formed by well-known techniques, such as screen printing or the photolithography.

A thin-film dividing layer 32 is formed on the resistance adjusting layer 30. The thin-film dividing layer 32 has horizontal line portions 33H formed individually on the horizontal line portions 31H of the resistance adjusting layer 30 and vertical line portions 33V formed individually on the vertical line portions 31V of the resistance adjusting layer 30. In the thin-film dividing layer 32, particles are dispersed with an appropriate density such that its surface is rugged, whereby a thin film that is formed by vapor deposition thereafter is divided. The thin-film dividing layer 32 is a little narrower than the light shielding layer 22. Among other numerical examples, the width of each horizontal line portion 33H is 260 μm, and the width of each vertical line portion 33V is 20 μm.

After the thin-film dividing layer 32 is formed, a smoothing process using a lacquer or the like is performed to smooth the metal back layer 7. A film for this smoothing process is consumed by firing after the metal back layer 7 is formed. Basically, this smoothing process is known in the field of CRTs and the like. For a region corresponding to the thin-film dividing layer 32, conditions are controlled so that a smoothing effect is lost.

After the smoothing process, the metal back layer 7 is formed by a thin film forming process. Thereupon, divided metal backs 7*a* are formed divided by a thin-film dividing layer 32. In this case, gaps between the divided metal backs 7*a* are substantially equal to the widths of the horizontal line portions 33H and the vertical line portions 33V of the thin-film dividing layer 32. X- and Y-direction dimensions g1 and g2 of each gap are 20 μm and 260 μm, respectively.

The following is a detailed description of how resistance values of the resistance adjusting layer 30 are set. Let it be supposed that the sheet resistances at the gaps g1 and g2 are ρg1 and ρg2, respectively, and that g1 and g2 designate the gap themselves, as well as the gap values. In the structure described above, ρg1 and ρg2 are substantially equal to the sheet resistances of the vertical line portions 31V and the horizontal line portions 31H, respectively. Let us suppose that resistances at the gaps g1 and g2 are Rg1 and Rg2, respectively. Rg1 and Rg2 are measured as resistances between the adjacent divided metal backs 7*a*. If the lengths of the vertical line portions and the horizontal line portions at division pitches are W1 and W2, respectively, Rg1 and Rg2 are given approximately by $$Rg1=\rho g1\cdot g1/W1,$$

$$Rg2=\rho g2\cdot g2/W2.$$

Although ρg1 and ρg2 are not always values for the resistance adjusting layer 30, in general, ρg1 and ρg2 are defined as values that are obtained by measuring Rg1 and Rg2 and calculating the above approximate expressions.

If electric discharge occurs, the voltage of the divided metal backs 7*a* at the site of the electric discharge lowers from the anode voltage toward the 0 V. Since the voltage drops of the adjacent divided metal backs are not equal, however, potential differences Vg1 and Vg2 are produced in the gaps g1 and g2, respectively. If the differences exceed the withstand voltages at the gaps, electric discharge inevitably occurs between the gaps. Thereupon, the gaps g1 and g2 are connected at low resistance by the electric discharge. In some cases, moreover, a phenomenon may occur such that electric discharges chain like an avalanche, thereby increasing current. In dividing the metal backs 7, therefore, it is very important to restrict voltages produced in divided parts to the withstand voltages or lower levels.

Since the behavior of a system in which the divided metal backs 7 are arranged two-dimensionally cannot be obtained analytically, it was examined by using an electric circuit simulator (SPICE).

In consequence, it was found that the following relations hold approximately in general:

$$Vg1\propto\sqrt{Rg1},$$

$$Vg2\propto\sqrt{Rg2}.$$

Electric fields Eg1 and Eg2 at the gaps g1 and g2 are given by $$Eg1=Vg1/g1,$$

$$Eg2=Vg2/g2.$$

Since the withstand voltages of gaps are substantially proportional to the gaps, in general, whether or not Eg1 and Eg2 attain critical electric fields for electric discharge indicates whether or not electric discharge occurs. Discharge current can be optimally minimized by substantially equalizing Eg1 and Eg2 and then setting the values in consideration of the withstand voltages. If there is any difference between Eg1 and Eg2, useless current equivalent to the difference flows inevitably. Otherwise, one of the withstand voltages is disadvantageous.

In view of manufacture, it is preferable to make a resistive layer with one material. The following is a description of results for this case. If g1=20 μm, W1=340 μm, g2=260 μ, and W2=180 μm are given as numerical examples, with ρg1=ρg2=ρg, we have $$Rg1/Rg2=0.04,$$

$$Vg1/Vg2=0.2,$$

$$Eg1/Eg2=2.6,$$

so that the electric field at the gap g1 becomes greater. Although these relations are based only on numerical examples, they also hold for practical dimensions. After all, Vg1 and Vg2 depend on Rg1 and Rg2 not in proportion to them but to their square roots, so that the electric field with the smaller gap g1 never fails to be greater.

According to the present embodiment, therefore, ρg1 is made smaller than ρg2. Preferably, moreover, Eg1=Eg2 should be given with $$0.5\leqq(Rg1/Rg2)^{1/2}/(g1/g2)\leqq 2.$$

In consideration of the flexibility of design and the difference between the withstand voltages at the portions g1 and g2, $(Rg1/Rg2)^{1/2}$ need not be entirely equal to (g1/g2), so that the range from 0.5 times to 2 times is permitted.

In order to obtain a discharge current restraining effect of a certain degree, Rg1 is expected to be $10^2$ Ω or more if Rg1 is selected as an index out of Rg1 and Rg2. If the resistance is raised too high, on the other hand, reduction of the luminance of the screen is nonnegligible, so that the upper limit value of the resistance is settled. Generally, as the beam current is in the order of 10 mA, Rg1=$10^5$ Ω is a substantial upper limit value based on the calculation of a voltage drop.

Rg1 may only be determined in total consideration of dimensions, restrictions on practical materials, target current, target luminance reduction, etc. within the aforesaid range.

An SED based on surface-conduction electron emitting elements was manufactured with use of the aforementioned front substrate, and electric discharge damage to it was evaluated. The resistance values were Rg1=$10^2$ Ω and Rg2=$10^4$ Ω. As in a third embodiment, which will be described later, a divided getter layer was also formed on the phosphor screen. In an FED having an anode voltage at 9 kV as a standard condition, the anode voltage was increased up to a maximum of 14 kV to cause electric discharge compulsorily. In consequence, a driver IC with an allowable current of 1 A was not broken after 100 cycles of electric discharge. Neither breakage nor degradation of the electron emitting elements was recognized. In this case, the discharge current was estimated to be 0.05 A, which is much lower than in the conventional case.

Figure 7:
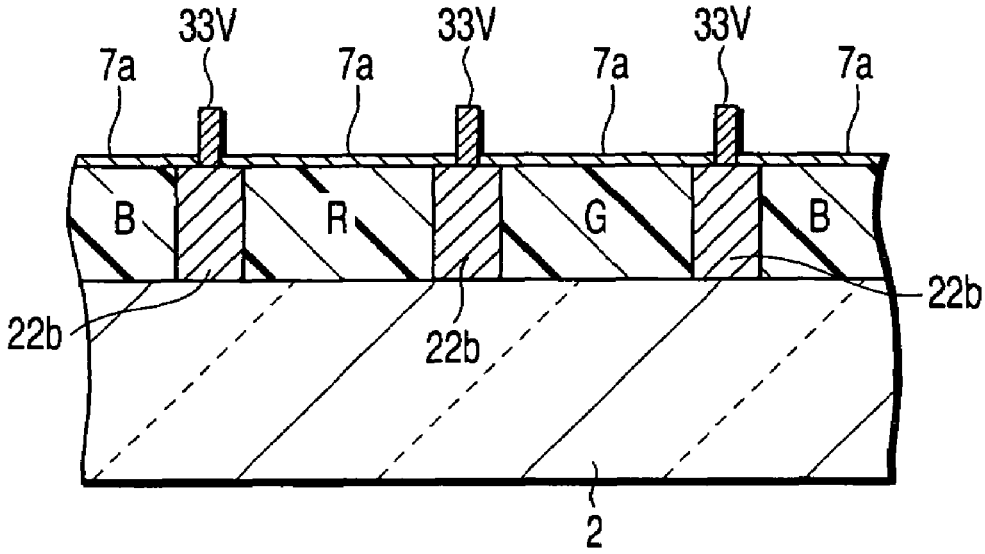
FIG. 7 is a sectional view showing a phosphor screen and the like of an SED according to a second embodiment of this invention.

FIG. 7 shows an X-direction sectional view of a phosphor screen and the like according to a second embodiment of the present invention. A Y-direction sectional view, which is easily supposable, is not shown. In the present embodiment, a light shielding layer 22 itself serves as a resistance adjusting layer. To achieve this, the resistance adjusting layer is formed of a blackish low-reflectance material that can rationalize the resistance without failing to meet requirements for the light shielding layer. Thus, the processes can be simplified, the yield can be improved, and the cost can be lowered. However, the degree of freedom of resistance adjustment is lowered.

Figure 8:
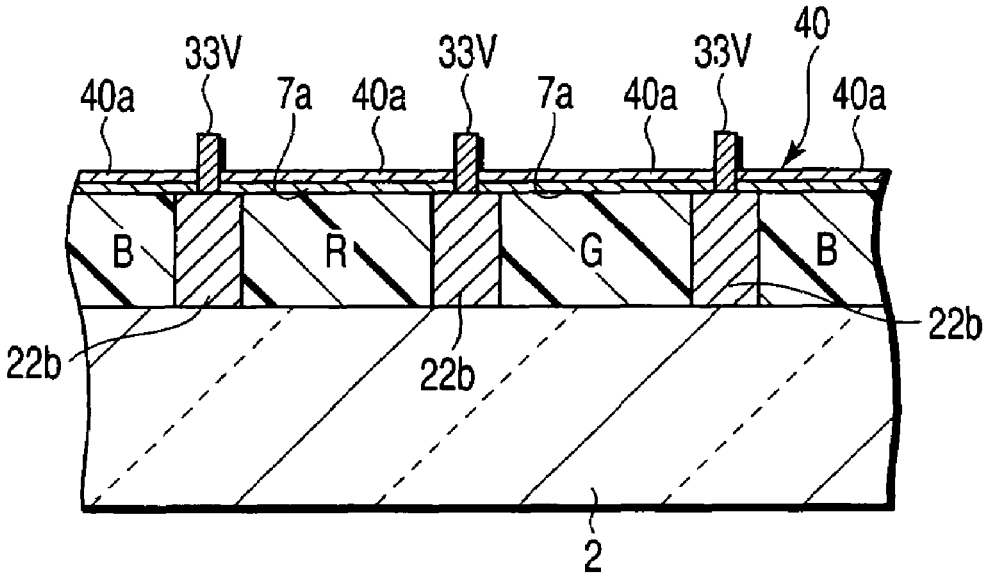
FIG. 8 is a sectional view showing a phosphor screen and the like of an SED according to a third embodiment of this invention.

FIG. 8 shows an X-direction sectional view of a phosphor screen according to a third embodiment of the present invention. A Y-direction sectional view, which is a similar view, is not shown. In the third embodiment, a getter layer 40 is further formed on a metal back layer 7. In order to secure a degree of vacuum in the SED for a long period of time, the getter layer 40 must sometimes be thus formed on the phosphor screen. The present embodiment is intended to deal with this case.

In general, a getter layer loses its function when it is exposed to the atmosphere. Therefore, a practical manufacturing method involves the getter layer 40 being formed by a thin film process, such as vapor deposition, as the front substrate 2, which is sealed with the rear substrate 1 in a vacuum. Since the function of the thin-film dividing layer cannot be lost even after the metal back layer 7 is formed, the getter layer 40 is also divided into the same pattern as the metal back layer 7, whereupon a divided getter layer 40*a*is formed. Although the getter layer 40 is generally an electrically conductive metal layer, therefore, the phosphor screen can avoid being electrically conducted even if the getter layer 40 is formed.

The resistance adjusting layer 30 described above is formed in a matrix corresponding to the matrix of the light shielding layer 22. Alternatively, the horizontal line portions 31H may be formed every two lines of pixels, and the vertical line portions 31V may be formed every pixel if one pixel is formed by combining R, G and B. By doing this, divisions of the metal back and the getter film can be reduced in number, so that advantages to the yield of product and the like can be obtained. It is to be understood, in general, that the division pitches can be variously selected within a range to attain the purpose.

As described above, according to the embodiments, there may be provided an image display device in which discharge current of electric discharge generated between a front substrate and a rear substrate is considerably reduced compared with the conventional case. Thus, additional countermeasures on the rear substrate side can be omitted to simplify the structure, so that processes can be reduced and the cost can be lowered. Further, the cost of the driver IC can be lowered. Furthermore, point defects, which would possibly occur in rare cases otherwise, can be prevented from occurring.

Moreover, there may be provided an image display device in which the anode voltage can be increased and a gap between the front substrate and the rear substrate can be lessened, so that characteristics including the luminance, resolution, and phosphor life are improved.

The present invention is not limited directly to the embodiments described above, and its components may be embodied in modified forms without departing from the spirit of the invention. Further, various inventions may be made by suitably combining a plurality of components described in connection with the foregoing embodiments. For example, some of all the components according to the foregoing embodiments may be omitted. Furthermore, components according to different embodiments may be combined as required.

Besides, the dimensions, materials, etc. of the individual components are not limited to the numerical values and materials described in connection with the foregoing embodiment, but may be variously selected as required.

What is claimed is:

1. An image display device comprising:

a front substrate having a phosphor screen, which includes phosphor layers and a light shielding layer, and a metal back layer superposed on the phosphor screen; and a rear substrate opposed to the front substrate and having thereon a plurality of electron emitting elements which emit electrons toward the phosphor screen, wherein the metal back layer includes a region which corresponds to the phosphor layers and is divided by gap g1 in a first direction and gap g2 in a second direction perpendicular to the first direction such that there are relations:

$$g1<g2, \text{ and}$$

$$\rho g1<\rho g2,$$

where ρ indicates a sheet resistance, and ρg1 and ρg2 are sheet resistances at the gaps g1 and g2, respectively.

2. The image display device according to claim 1, wherein there are relations:

$$0.5 \leqq (Rg1/Rg2)^{1/2}/(g1/g2) \leqq 2,$$

where Rg1 and Rg2 are resistances at the gaps g1 and g2, respectively.

3. The image display device according to claim 2, wherein Rg1 is given by $10^2$ Ω≦Rg1≦$10^5$ Ω.

4. The image display device according to claim 1 wherein the metal back layer is formed with a getter layer superposed thereon, the getter layer being divided into a pattern corresponding to that of the metal back layer.

* * * * *